US005584168A

United States Patent [19]

Artzt et al.

[11] Patent Number: 5,584,168

[45] Date of Patent: Dec. 17, 1996

[54] RING AND TRAVELLER SYSTEM FOR SPINNING AND TWISTING FRAMES

[75] Inventors: Peter Artzt, Reutlingen; Eckhard Sonntag, Waiblingen; Helmut Sommer, Reichenbach; Hans-Dieter Weber, Esslingen, all of Germany

[73] Assignee: Cerasiv GmbH, Innovatives Keramik-Engineering, Plochingen, Germany

[21] Appl. No.: 353,511

[22] Filed: Dec. 9, 1994

[30] Foreign Application Priority Data

Dec. 10, 1993 [DE] Germany ..... 43 42 148.2

[51] Int. Cl.[6] ..... D01H 7/52; D01H 7/62

[52] U.S. Cl. ..... 57/119; 57/120; 57/125

[58] Field of Search ..... 57/119, 120, 125

[56] References Cited

U.S. PATENT DOCUMENTS

| | | | |
|---|---|---|---|
| 3,036,422 | 5/1962 | Stähli et al. | 57/125 |
| 3,381,464 | 5/1968 | Fürst | 57/119 |
| 3,416,301 | 12/1968 | Chilpan | 57/119 |
| 4,677,817 | 7/1987 | Kanai | 57/125 |
| 4,698,958 | 10/1987 | Nakano et al. | 57/119 |
| 5,086,615 | 2/1992 | Bodnar | 57/119 X |
| 5,175,988 | 1/1993 | Kibe | 57/119 |

FOREIGN PATENT DOCUMENTS

| | | | |
|---|---|---|---|
| 0201602 | 11/1986 | European Pat. Off. . | |
| 3545484 | 7/1987 | Germany . | |
| 3839920 | 6/1989 | Germany . | |
| 4219197 | 12/1993 | Germany . | |
| 79/00249 | 5/1979 | WIPO | 57/119 |

*Primary Examiner*—William Stryjewski
*Attorney, Agent, or Firm*—Felfe & Lynch

[57] ABSTRACT

Disclosed is an improved ring and traveller system for spinning and twisting frames. At least the surface of the ring coming into contact with the traveller consists of a polycrystalline ceramic material and the ceramic surface of the ring has a surface structure with rounded grain boundaries which form a storage volume for a self-generating lubricating film of fibers. The traveller consists of a resilient carrier material, especially metal, and has a metal and/or ceramic surface, the hardness of which is greater than the hardness of the ceramic surface of the ring.

16 Claims, 1 Drawing Sheet

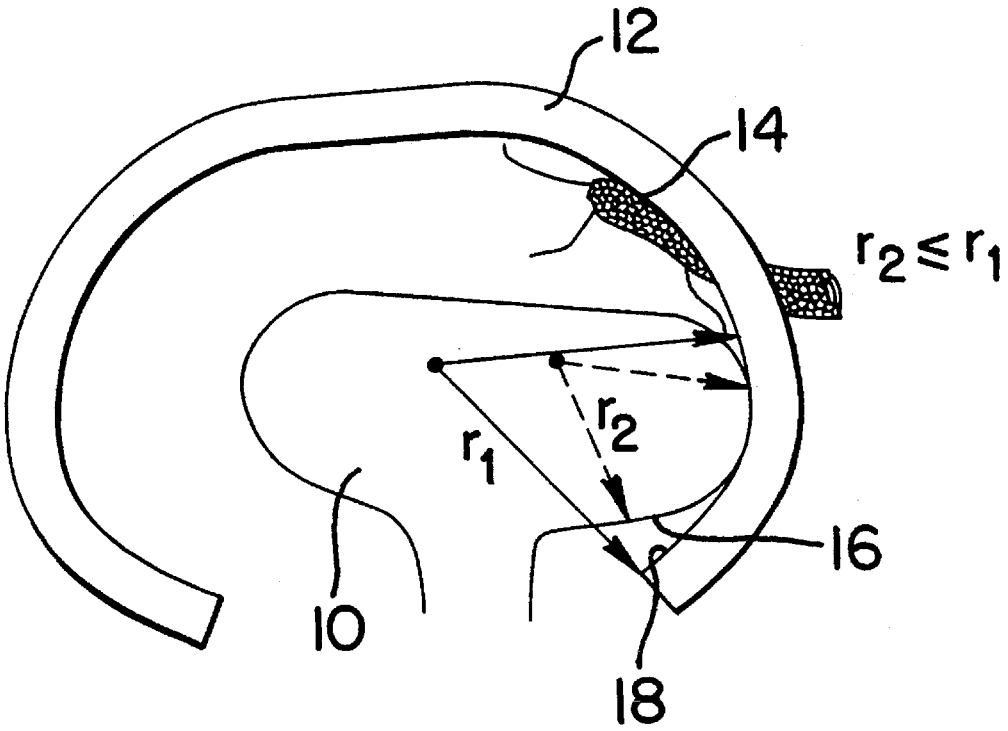
12
14
$r_2 \leq r_1$
$r_2$
$r_1$
16
10
18

RING AND TRAVELLER SYSTEM FOR SPINNING AND TWISTING FRAMES

BACKGROUND AND INVENTION

The invention relates to a ring and traveller system for spinning and twisting frames.

In ring spinning, travellers that rotate on rings at high relative speed are used. Under industrial conditions, the travellers currently attain a relative speed of up to 40 m/s without active lubrication.

The manufacture of the ring and the traveller from hardened steel or steel wire is known in the art (DE-A1-32 10 133).

Worldwide, there are about 150 million ring spindles, all of which are equipped with metal rings. In the ring spinning works of highly industrialized countries, machine-related performances of more than 90% are currently being achieved. However, the annual performance is considerably lower due to necessary maintenance and repair work. A substantial portion of the down time of a ring spinning frame is attributable to replacing the traveller which must be replaced at regularly recurring intervals. Depending on the spinning conditions, the abrasion stresses acting on the traveller are so high that the traveller must be changed frequently, i.e. daily, weekly, or at most every second week. As the traveller becomes increasingly worn, the yarns collect more burls and fibre accumulations and become more hairy. This last condition in particular causes problems in subsequent processing.

The changing of the traveller and the subsequent restarting of the ring spinning frame are manual operations. Since all of the about 600 to 1,100 spinning points of the ring spinning frame have to be replaced with new travellers, such operations require a considerable number of personnel. Inevitably, all the filaments are broken. Occasionally, the used travellers fall into the machine cavity. The fallen travellers are difficult to remove.

The ring, as a complementary part, has a load-dependent service life ranging from one to four years. A decline in the efficiency of the rings is inevitably accompanied by an increase in the thread breakage rates, increased traveller wear and deteriorating yarn properties. Replacement of these rings necessitates extensive machine down time because of the ring change-over and the complicated, but necessary, centering of the new rings. Subsequently, ring breaking-in periods lasting several days are required resulting in additional production losses due to frequent traveller change and lower spindle speed.

If this ring breaking-in period is not performed according to the manufacturer's specifications, the rings may suffer damage. With the high quality standards demanded of ring-spun yarn, this running-in phase results in the production of wasted yarn.

Extensive development work has revealed that the central problem lies in the abrasion of material in the form of hard micro-welds of the traveller material onto the ring surface. As a result, an originally ideally polished ring surface is worn into a microscopic mountain range. The traveller, which slides over such a surface, exhibits an increasing tendency to scuff. The traveller's running conditions on the ring become continuously worse and the efficiency of the machine deteriorates. In addition, the pairing of a steel ring and steel traveller as a galvanic element has the propensity to corrode during machine stoppages (work holidays and so on) or in a hostile environment. Re-starting of the machine is then associated with serious breakdowns in the form of high thread breakage rates. The end result is considerable economic loss attributable to machine down time.

Attempts at active lubrication of the ring and traveller system in cotton spinning have lead to no improvement. Since only extremely small amounts of lubricant can be used, the exact dosing, where thousands of spindles are involved, is an extremely difficult task. Over-dosing results in the cops becoming soiled.

Many years of research work in the fields of improving the surface quality, degrees of hardness, metal alloys, coatings, both of the traveller and of the ring, have so far failed to satisfactorily solve these problems.

Because the traveller is considerably less expensive than the ring, the hardness of the traveller has always been specified to be somewhat less than the hardness of the ring, so that the traveller wears before the ring.

For a long time there has been an attempt to provide the ring with a ceramic coating (DE-A1 38 39 920). The very hard ceramic ring causes an over-proportional wear of the traveller. The traveller cannot survive even one drawing-off operation, that is to say, a spinning time of 4 to 8 hours.

Providing the traveller with a ceramic coating layer has also been attempted (DE-A1 35 45 484). The ring and traveller system did not, however, satisfy the required demands of a protracted service life.

The invention is therefore based on the problem of developing a ring and traveller system for spinning and twisting frames which has a significantly improved service life and allows a higher production speed, with identical or improved yarn properties, and thus makes a material contribution to increased economic efficiency.

The various features of novelty which characterize the invention are pointed out with particularity in the claims annexed to and forming a part of this specification. For a better understanding of the invention, its operating advantages and specific objects obtained by its use, reference should be made to the accompanying drawings and descriptive matter in which there is illustrated and described a preferred embodiment of the invention.

BRIEF DESCRIPTION OF THE DRAWING

The FIGURE shows in section a ring with a traveller in position thereon.

THE INVENTION

The invention is in an improved ring and traveller system which solves the above-discussed problems.

In the system of the invention, wear of the ring and of the traveller is minimized. The ring comes into contact with the traveller. Important in the invention are the materials used and the surface structure. At least the surface of the ring coming into contact with the traveller consists of a polycrystalline ceramic material. The ceramic surface of the ring has a surface structure having rounded grain boundaries which forms a storage volume for a self-generating lubricating film of fibers. The traveller consists of a resilient carrier material, especially metal, and has a metal and/or ceramic surface, the hardness of which is greater than the hardness of the ceramic surface of the ring.

In addition, the special surface structure of the ring enables self-lubrication. The surface of the ring coming into contact with the traveller is constructed from a polycrystalline ceramic material. Preferred ceramic materials are those having a heat conducting capability at least equal to that of steel. Such a construction significantly increases the service life of the ring. The construction of the surface structure by which the self-lubrication is assured is an important feature of the invention.

Self-lubrication is obtained from portions of fiber that get between the ring and the traveller and are sheared off thread. These sheared-off or torn-off portions of thread are pressed by the moving traveller into the storage volume of the ring surface and consequently form a-self-generating lubricating film for the traveller.

In conjunction with the ceramic surface, this lubricating film enables the metal and/or ceramic surface of the traveller to have, according to the invention, a hardness that is substantially identical to, or greater than, the hardness of the ceramic surface of the ring. The wear of the traveller is likewise significantly reduced by this measure.

The invention permits achievement of unexpected results in the form of an extended service life. The quality of the thread suffers no ill effects, even with a ring and traveller system that has been operational for some time, since hardly any wear of the ring and the traveller that could damage the thread occurs.

In a preferred embodiment, the ring consists entirely of ceramic material. This embodiment considerably facilitates the production process. It is, of course, also possible to provide just the running surface of the ring with a layer of polycrystalline ceramic material.

Advantageously, the surface structure of the ceramic surface of the ring is achieved by means of an ensuing mechanical, chemical or thermal treatment process. A combination of these treatment processes is also advantageous.

Suitable mechanical treatment processes include, but are not limited to, for example:

(a) bombardment with hard materials such as $Al_2O_3$, kaolin, $SiO_2$, boron carbide or diamond;

(b) water jet treatment at a pressure of from 1,000 to 4,000 bars with additions of hard materials;

(c) treatment with soft carriers doped with hard materials, such as, for example, felts/brushes and diamond; and (d) immersion in suspensions of hard material at relative speeds.

Suitable chemical treatment processes include, but are not limited to, for example:

(e) etching by means of concentrated phosphoric acid, 5 to 10% strength hydrofluoric acid or concentrated sulfuric acid; and (f) etching for a period of 1 to 15 minutes at temperatures from 20° to 250° C. with, for example, $K_2S_2O_4$, $V_2O_5$ or borax.

Suitable thermal treatment processes include, but are not limited to, for example:

(g) thermally etching the component after sintering and mechanical and/or chemical treatment at a temperature of more than 1,000° C. for a period of at least 4 hours; and (h) treatment by means of ion beams and plasma etching.

The best test results were achieved by a combination of treatment processes such as a thermal treatment followed by a mechanical treatment.

It has been found that a hardness of the ceramic surface of the ring of about 80 Rockwell (C Scale) is especially advantageous. As already mentioned, the hardness of the metal and/or the ceramic traveller surface is greater than or about the same as the hardness of the ceramic surface of the ring.

According to the invention, the grain surface roughness of the ceramic surface of the ring is from about 0.2 to 2 μm. The grain surface roughness is the roughness factor $R_k$, which is defined in the German Standard DIN 4776, including the supplement to this DIN standard. The German Standard DIN 4776 describes the measurement of surface roughness parameters $R_k$, $R_{pk}$, $R_{vk}$, $Mr_1$ $Mr_2$ for the description of the material portion (profile bearing length ratio) in the roughness profile, measuring correlations and evaluation procedures.

It is important that the metal and/or ceramic surface of the traveller has no solubility in, and no tendency to diffuse into, the ceramic surface of the ring. Therefore, plain steel and nickel coatings are not recommended.

Advantageously, the faces of the ring and the traveller facing one another have a different radius of curvature, the radius of curvature of the ring being less than that of the traveller, so that contact is approximately a point contact.

The following ceramics have proved especially useful as the material for the ceramic surface of the ring and of the ring of solid ceramic: oxides of a) Al, Si, Zr; b) SiC, $Si_3N_4$, BN, $B_4C$, diamond; and c) carbides, nitrides, borides and silicides of the elements of the subgroups IV, V and VI. Mixtures of, or including, the materials of a), b) and c) can also be used.

The metal and/or ceramic surface of the traveller is advantageously selected from the following substances: chromium, vanadium, and also mixtures thereof; carbides, nitrides, borides and silicides of the elements of the subgroups IV, V and VI, and also mixtures thereof; titanium aluminum nitride; SiC, $Si_3N_4$, BN, $B_4C$, diamond; oxides of aluminum, silicon or zirconium and also mixtures thereof.

The Figure shows in section a construction according to the invention with a ring 10 and a traveller 12 in position thereon. The operational position is shown, that is, an instantaneous image of a rotating traveller 12. A thread 14 (shown only in an outline form) is located between the traveller 12 and the ring 10. Face 16 of ring 10 and face 18 of traveller 12 oppositely face one another but have a different radius of curvature r, the radius of curvature $r_2$ of ring 10 being less than the radius of curvature $r_1$ of traveller 12. There is consequently approximately a point contact between ring 10 and traveller 12.

It will be understood that the specification and examples are illustrative but not limitative of the present invention and that other embodiments within the spirit and scope of the invention will suggest themselves to those skilled in the art.

We claim:

1. A ring and traveller system for spinning and twisting frames, comprising: a ring having a surface which contacts a traveller, the ring surface comprising a polycrystalline ceramic material and having rounded grain boundaries which form a storage volume for a self-generating lubricating film of fibers; the traveller comprising a resilient carrier material, and having a ceramic surface with a hardness which is greater than the hardness of the ceramic surface of the ring.

2. The ring and traveller system of claim 1 wherein the ring is formed entirely of a ceramic material.

3. The ring and traveller system of claim 1 wherein the surface structure of the ceramic surface of the ring is formed by at least one of a mechanical, chemical or thermal treatment process.

4. The ring and traveller system of claim 1 wherein the hardness of the ceramic surface of the ring is about 80 Rockwell C Scale.

5. The ring and traveller system of claim 1 wherein the ceramic surface of the ring has a grain surface roughness of from 0.2 to 2 μm.

6. The ring and traveller system of claim 1 wherein B contact of the ring and traveller is approximately point contact.

7. The ring and traveller system of claim 1 wherein the ring or the ceramic surface of the ring is of at least one material selected from the group consisting of: a) oxides of Al, Si, Zr; b) SiC, $Si_3N_4$, BN, $B_4C$, diamond; and c) carbides, nitrides, borides and silicides of the elements of the subgroups IV, V and VI of the Periodic Table of Elements.

8. The ring and traveller system of claim 1 wherein the surface of the traveller is of at least one material selected from the group consisting of: carbides, nitrides, borides and silicides of the elements of the subgroups IV, V and VI of the Periodic Table of Elements; titanium aluminum nitride; SiC, $Si_3N_4$, BN, $B_4C$, diamond; and oxides of aluminum, silicon or zirconium.

9. The ring and traveller system of claim 1 wherein the resilient carrier material is metal.

10. The ring and traveller system of claim 9 wherein the contact of the ring and traveller is approximately point contact.

11. The ring and traveller system of claim 10 wherein the traveller has a ceramic surface extending along the traveller surface approximately at the area of contact.

12. The ring and traveller system of claim 9 wherein the ring or the ceramic surface of the ring is of at least one material selected from the group consisting of: a) oxides of Al, Si, Zr; b) SiC, $Si_3N_4$, BN, $B_4C$, diamond; and e) carbides, nitrides, borides and silicides of the elements of the subgroups IV, V and VI of the Periodic Table of Elements.

13. The ring and traveller system of claim 1 wherein the resilient carrier material is ceramic.

14. The ring and traveller system of claim 13 wherein B contact of the ring and traveller is approximately point contact.

15. The ring and traveller system of claim 13 wherein the ring or the ceramic surface of the ring is of at least one material selected from the group consisting of: a) oxides of Al, Si, Zr; b) SiC, $Si_3N_4$, BN, $B_4C$, diamond; and c) carbides, nitrides, borides and silicides of the elements of the subgroups IV, V and VI of the Periodic Table of Elements.

16. The ring and traveller system of claim 13 wherein the surface of the traveller is at least one material selected from the group consisting of carbides, nitrides, borides and silicides of the elements of the subgroups IV, V and VI of the Periodic Table of Elements; titanium aluminum nitride; SiC, $Si_3N_4$, BN, $B_4C$, diamond; and oxides of aluminum, silicon or zirconium.

* * * * *